US009504924B2

(12) United States Patent
Hunter

(10) Patent No.: US 9,504,924 B2
(45) **Date of Patent: *Nov. 29, 2016**

(54) REDUCING RADIUS SLIDE FEATURE

(71) Applicant: Richard D. Hunter, Ottawa (CA)

(72) Inventor: Richard D. Hunter, Ottawa (CA)

(73) Assignee: Proslide Technology Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/222,017

(22) Filed: Mar. 21, 2014

(65) Prior Publication Data

US 2014/0206467 A1 Jul. 24, 2014

Related U.S. Application Data

(63) Continuation of application No. 13/567,184, filed on Aug. 6, 2012, now Pat. No. 8,690,697, which is a continuation of application No. 12/732,074, filed on Mar. 25, 2010, now Pat. No. 8,262,494, which is a continuation of application No. 11/381,557, filed on May 4, 2006, now Pat. No. 7,713,134, which is a continuation-in-part of application No. 11/061,860, filed on Feb. 18, 2005, now Pat. No. 7,056,220, which is a continuation of application No. 10/464,833, filed on Jun. 18, 2003, now Pat. No. 6,857,964.

(60) Provisional application No. 60/389,878, filed on Jun. 18, 2002.

(51) Int. Cl.

| | |
|---|---|
| ***A63G 21/00*** | (2006.01) |
| ***A63G 21/02*** | (2006.01) |
| ***A63G 21/18*** | (2006.01) |
| *A63G 21/10* | (2006.01) |

(52) U.S. Cl.

CPC ..... *A63G 21/00* (2013.01); *A63G 21/02* (2013.01); *A63G 21/18* (2013.01)

(58) Field of Classification Search

CPC ..... A63G 3/00; A63G 3/02; A63G 21/00; A63G 21/10; A63G 21/18; A63G 31/00; A63B 69/0093

USPC ..... 472/116–117, 128, 129, 88–90; 104/69, 104/70

See application file for complete search history.

(56) References Cited

U.S. PATENT DOCUMENTS

| | | | |
|---|---|---|---|
| 728,246 | A | 5/1903 | Kremer |
| 920,567 | A | 5/1909 | Hayes |
| 953,266 | A | 3/1910 | Healy |
| 1,655,498 | A | 1/1928 | Fisch |

(Continued)

FOREIGN PATENT DOCUMENTS

| | | |
|---|---|---|
| GB | 2224948 | 5/1990 |

*Primary Examiner* — Kien Nguyen

(74) *Attorney, Agent, or Firm* — Barnes & Thornburg LLP

(57) ABSTRACT

A slide feature is adapted to carry one or more riders and/or ride vehicles sliding thereon. The slide feature includes a sliding surface having an entry end and an exit end. The sliding surface comprising at least a lower portion of a sideways tilted funnel shape wherein a radius of the sliding surface tapers from the entry end to the exit end. A lowermost surface of the sliding surface is horizontal or slightly inclined from horizontal descending from the entry end to the exit end. The sliding surface comprising side walls each extending upward from the lowermost surface about a longitudinal axis which would be defined by the complete sideways tilted funnel shape through an angle of more than 90°. The entry end is substantially larger in diameter than the exit end.

16 Claims, 9 Drawing Sheets

(56) References Cited

U.S. PATENT DOCUMENTS

| | | | |
|---|---|---|---|
| 1,745,241 | A | 1/1930 | Bartlett |
| 2,254,482 | A | 9/1941 | Heller |
| D210,298 | S | 2/1968 | Moulton |
| 3,830,161 | A | 8/1974 | Bacon |
| 3,853,067 | A | 12/1974 | Bacon |
| 4,129,916 | A | 12/1978 | Schlesinger et al. |
| 4,172,593 | A | 10/1979 | Palakanis |
| 4,192,499 | A | 3/1980 | Groves, Jr. |
| D256,827 | S | 9/1980 | Allen |
| D256,828 | S | 9/1980 | Allen |
| D256,940 | S | 9/1980 | Allen |
| D257,874 | S | 1/1981 | Sheehan et al. |
| 4,278,247 | A | 7/1981 | Joppe et al. |
| 4,339,122 | A | 7/1982 | Croul |
| D266,346 | S | 9/1982 | Millay et al. |
| 4,444,290 | A | 4/1984 | Valerio, Jr. |
| 4,484,739 | A | 11/1984 | Kreinbihl et al. |
| 4,652,199 | A | 3/1987 | Pole |
| 4,750,733 | A | 6/1988 | Foth |
| 4,805,896 | A | 2/1989 | Moody |
| 4,805,897 | A | 2/1989 | Dubeta |
| 4,836,521 | A | 6/1989 | Barbar |
| 4,893,447 | A | 1/1990 | Opp et al. |
| 5,137,497 | A | 8/1992 | Dubeta |
| 5,433,671 | A | 7/1995 | Davis |
| 5,453,054 | A | 9/1995 | Langford |
| 5,482,510 | A | 1/1996 | Ishii et al. |
| 5,540,622 | A | 7/1996 | Gold et al. |
| 5,735,748 | A | 4/1998 | Meyers et al. |
| 5,779,553 | A | 7/1998 | Langford |
| 6,354,955 | B1 | 3/2002 | Stuart et al. |
| 6,450,891 | B1 | 9/2002 | Dubeta |
| 6,485,372 | B2 | 11/2002 | Stuart et al. |
| 6,743,107 | B2 | 6/2004 | Dubeta |
| 6,857,964 | B2 | 2/2005 | Hunter |

REDUCING RADIUS SLIDE FEATURE

CROSS-REFERENCE TO RELATED APPLICATIONS

This is a continuation of prior U.S. application Ser. No. 13/567,184, filed Aug. 6, 2012, which is a continuation of U.S. application Ser. No. 12/732,074, filed Mar. 25, 2010, which is a continuation of U.S. application Ser. No. 11/381,557, filed May 4, 2006, which is a continuation-in-part of U.S. application Ser. No. 11/061,860, filed Feb. 18, 2005, which is a continuation of U.S. application Ser. No. 10/464,833, filed Jun. 18, 2003, which claims priority benefit under 35 U.S.C. 119(e) of U.S. Provisional Application No. 60/389,878, filed Jun. 18, 2002, the contents of which are hereby incorporated herein by reference.

BACKGROUND OF THE INVENTION

1. Field of the Invention

The invention relates in general to flume rides, and more particularly, to an improved water flume thrill ride having a reducing-radius or funnel-shaped slide feature.

2. Description of the Related Art

Water slides, flumes and the like are popular ride attractions for water parks, theme parks, family entertainment centers and destination resorts. Water slides not only offer welcome relief from the summer heat, they also provide an exciting and entertaining diversion from conventional pool and/or ocean bathing activities.

In a typical water slide or flume, a bather or rider slides his body and/or a flexible riding mat, tube or raft ("ride vehicle") along a downward-inclined sliding surface defined by a flume or water channel that bends, twists and turns following a predetermined ride path. The flume also typically carries a flow of water from a starting pool at some desired higher elevation to a landing pool or run-out at a desired lower elevation. The water is typically continuously recirculated from the lower elevation to the higher elevation using one or more pumps and then continuously falls with gravity from the higher elevation to the lower elevation flowing along the slide/flume path. The water provides cooling fun for the ride participants, and also provides a lubricious film or fluid between the rider/vehicle and the ride surface so as to increase the speed of the rider down the flume path.

The popularity of such water slide rides has increased dramatically over the years, as they have proliferated and evolved into ever larger and more exciting rides. Nevertheless, park patrons continue to demand and seek out more and more exciting and stimulating ride experiences. Thus, there is an ever present demand and need for different and more exciting flume ride designs that offer riders a new and unique ride experience and that give park owners the ability to draw larger and larger crowds to their parks.

SUMMARY OF THE INVENTION

The present invention addresses these and other needs and demands by providing an improved slide feature and associated slide effect offering riders a new and unique ride experience unlike any other they have experienced before. In particular, a flume ride is provided having a funnel shaped slide feature configured and arranged such that a rider enters the wide end of a tilted funnel and swings back and forth and/or spins around the inner surface of the funnel before safely draining through the small end.

In another embodiment a flume ride is provided comprising a generally downwardly-inclined main slide path sized and adapted to carry one or more riders and/or ride vehicles sliding thereon. The flume ride includes a generally funnel-shaped slide feature having a substantially enclosed conical sliding surface having an entry end sized and adapted for receiving riders/vehicles from the main slide path and an exit end. The conical sliding surface is tilted on its side such that a lower-most surface thereof is at least parallel to or slightly inclined from horizontal descending from the entry end to the exit end and wherein the entry end is substantially larger in diameter than the exit end.

In another embodiment a slide feature is provided comprising a substantially enclosed, reducing-radius sliding surface having an entry end and an exit end. The entry end is substantially round, oval or oblong in shape and has an entry slide portion for safely admitting riders and/or ride vehicles with a predetermined expected velocity. The sliding surface substantially smoothly tapers from the entry end to a substantially smaller exit end and is tilted such that a rider/vehicle entering the sliding surface at the entry end is caused to swing back and forth and/or spin around the sliding surface as he or she advances through the reducing radius sliding surface toward the exit end. Optionally, the slide feature may be configured such that the rider/vehicle can swing up to or above a vertical portion of the sliding surface, or indeed to swing completely around the sliding surface.

In still further embodiments, the above slide features are fully enclosed, providing a sliding experience that is not only safer than slide features that are only substantially enclosed, but also significantly more thrilling, as the fully enclosed slide feature can be made to be substantially or completely dark inside.

In another embodiment, the invention provides a flume ride having a plurality of the above slide features. The presence of multiple funnel shaped slide features in the flume ride provides a more thrilling sliding experience than a flume ride with only one such feature.

Thus, in a broad aspect, the invention provides a slide feature comprising an entry slide path sized and adapted to carry one or more riders and/or ride vehicles sliding thereon, and a generally symmetrically formed main funnel portion having a conical sliding surface, an entry end sized and adapted for receiving riders/vehicles from said entry slide path, and an exit end, wherein said main funnel portion is tilted on its side relative to a central axis thereof such that a lower-most surface thereof is at least parallel to or slightly inclined from horizontal descending from said entry end to said exit end, said entry end is substantially larger in diameter than said exit end, and said entry end of said main funnel portion is substantially covered.

In another aspect, the invention provides a slide feature comprising an entry slide path sized and adapted to carry one or more riders and/or ride vehicles sliding thereon, and a generally symmetrically formed main funnel portion having a conical sliding surface, an entry end sized and adapted for receiving riders/vehicles from said entry slide path, and an exit end, wherein said main funnel portion is tilted on its side relative to a central axis thereof such that a lower-most surface thereof is at least parallel to or slightly inclined from horizontal descending from said exit end, said entry end is substantially larger in diameter than said exit end, and wherein a rider/vehicle entering the main funnel portion is caused to swing back and forth, occasionally past a vertical slope, upon the sliding surface as he or she advances through the sliding surface toward said exit end.

In a further aspect, the invention provides a flume ride comprising a ride entry, a ride exit, and a plurality of conical slide features intermediate said ride entry and said ride exit, interconnected by connecting slide paths, wherein each said conical slide feature comprises an entry slide path sized and adapted to carry one or more riders and/or ride vehicles sliding thereon, and a generally symmetrically formed main funnel portion having a conical sliding surface, an entry end sized and adapted for receiving riders/vehicles from said entry slide path, and an exit end, wherein said main funnel portion is tilted on its side relative to a central axis thereof such that a lower-most surface thereof is at least parallel to or slightly inclined from horizontal descending from said entry end to said exit end, and said entry end is substantially larger in diameter than said exit end.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which.

DESCRIPTION OF THE PREFERRED EMBODIMENTS

Figure 1:
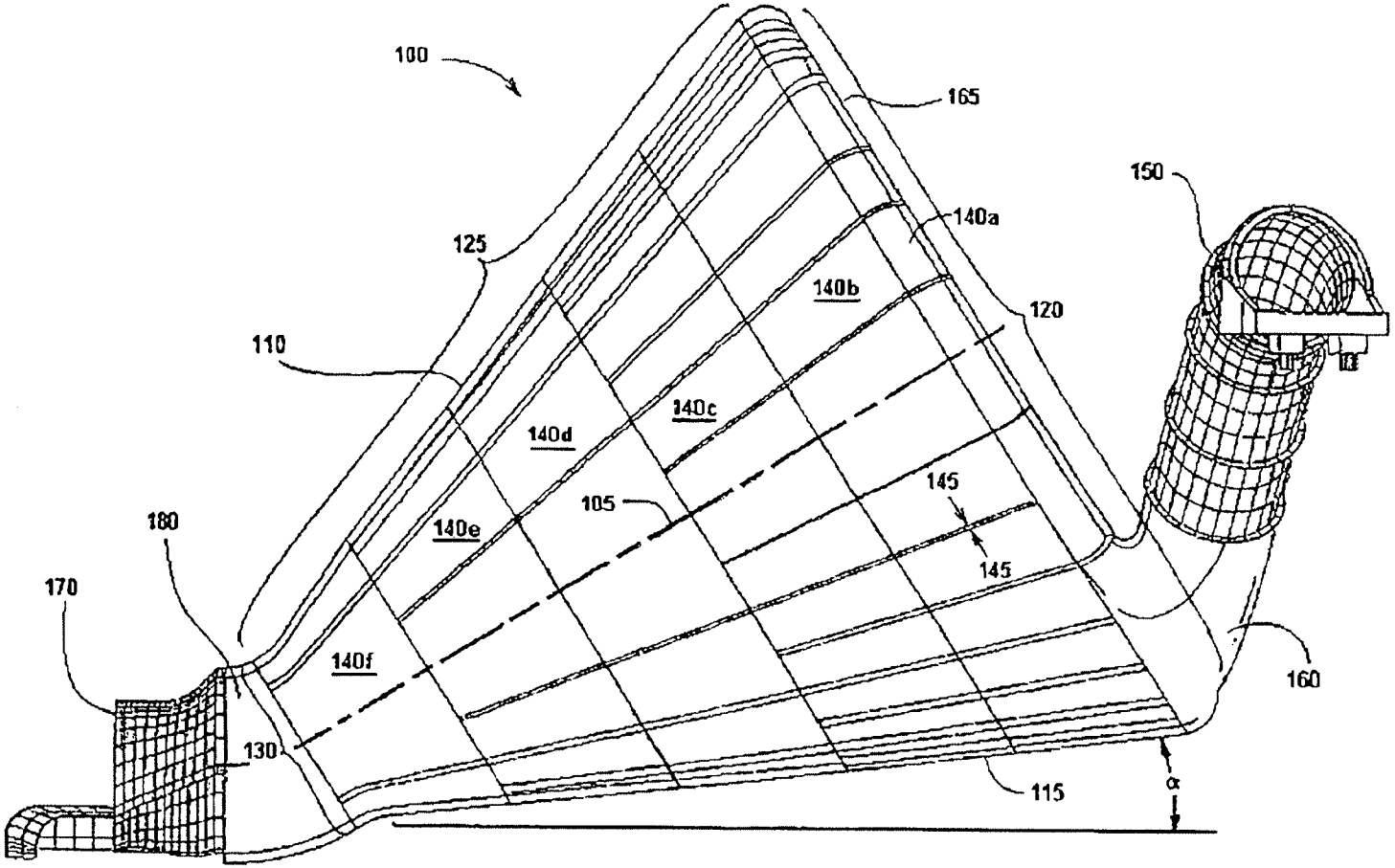
FIG. 1 is a left side elevation view of one embodiment of a reducing radius slide feature having features and advantages in accordance with the present invention.

The figures illustrate in one embodiment a flume ride comprising a generally downwardly-inclined main slide path sized and adapted to carry one or more riders 200 and/or ride vehicles 210, 220 sliding thereon. The flume ride includes a generally funnel-shaped slide feature 100 having a substantially enclosed conical sliding surface 110 having an entry end 120 sized and adapted for receiving riders/vehicles from the main slide path and an exit end 130. The conical sliding surface 110 is tilted on its side such that a lower-most surface 115 thereof is at least parallel to or slightly inclined from horizontal descending from the entry end 120 to the exit end 130 and wherein the entry end 120 is substantially larger in diameter than the exit end 130. The figures illustrate in another embodiment a slide feature 100 comprising a substantially enclosed, reducing-radius sliding surface 110 having an entry end 120 and an exit end 130. The entry end 120 is substantially round, oval or oblong in shape and has an entry slide portion 150 for safely admitting riders and/or ride vehicles with a predetermined expected velocity. The sliding surface 110 substantially smoothly tapers from the entry end 120 to a substantially smaller exit end 130 and is tilted such that a rider/vehicle 200, 210, 220 entering the sliding surface 110 at the entry end 120 is caused to swing back and forth and/or spin around the sliding surface 110 as he or she advances through the reducing radius sliding surface 110 toward the exit end 130.

Figure 2:
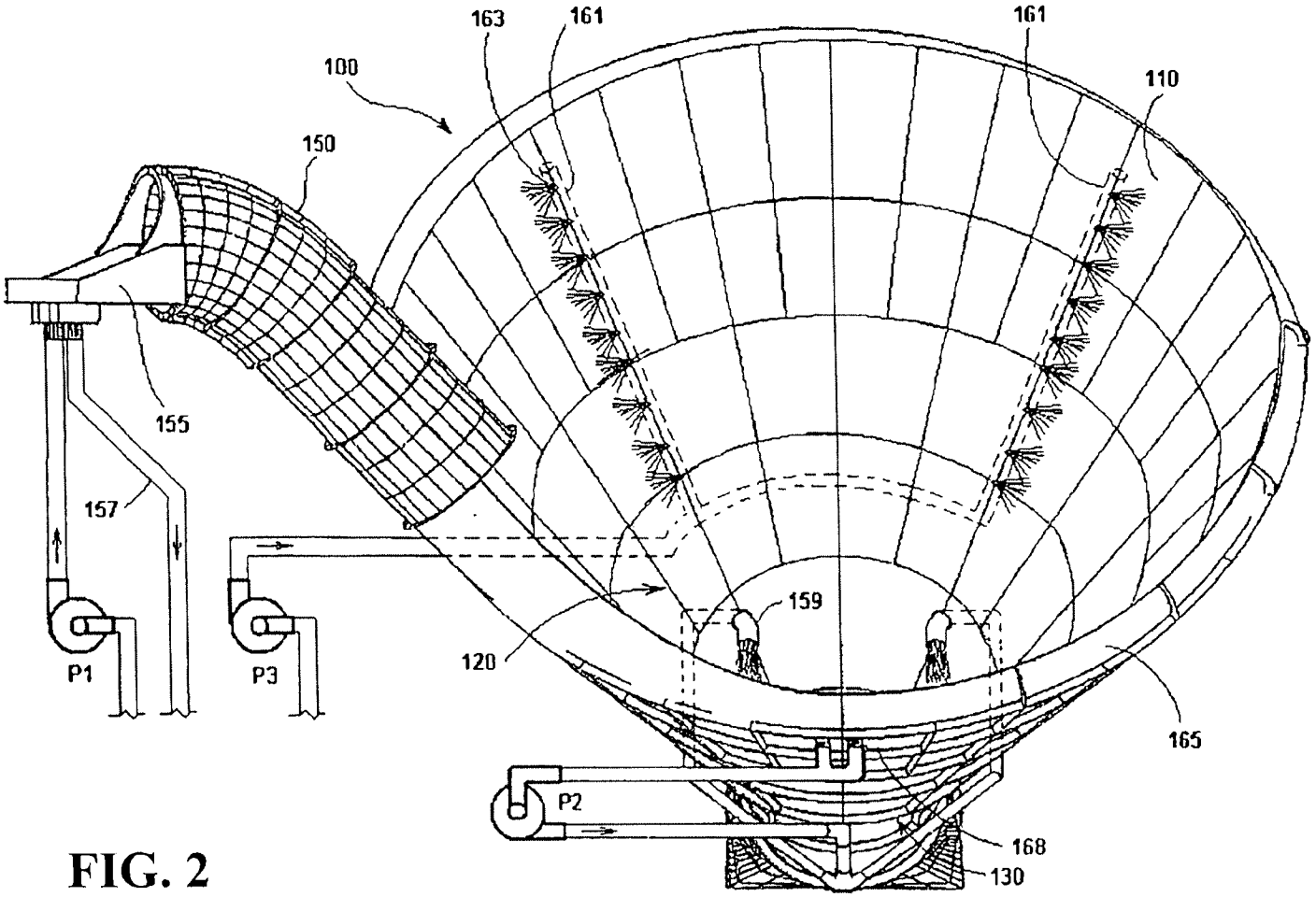
FIG. 2 is a front side elevation view of the reducing radius slide feature of FIG. 1.

FIGS. 1 and 2 are left and front side elevation views, respectively, of one embodiment of a reducing-radius slide feature 100 having features and advantages in accordance with the present invention. The slide feature generally comprises an enclosed conical or funnel-shaped fiberglass slide surface 110 formed more-or-less symmetrically about a central axis 105. While a generally round, conical or funnel-shaped slide surface 110 is preferred, any variety of other suitable symmetric or non-symmetric reducing-radius shapes may also be used, including oblong, oval, flared, horn or bell-shaped funnels and the like. The funnel-shaped fiberglass slide surface 110 is generally defined by a main body portion 125 that smoothly tapers from a relatively larger entry end 120 to a relatively smaller exit end 130, as illustrated. The main body portion 125 may be fixed and/or rotatably mounted, as desired. For example, the main body portion 125 may be mounted on one or more bearings and rotated about axis 105 for both visual appeal and increased thrill value.

The entire structure is preferably placed on its side and tilted at least slightly toward exit end 130 such that the lower-most portion 115 of the slide surface 110 forms an included incline angle $\alpha$ with horizontal, preferably measuring between 0 (parallel to horizontal) and 30 degrees and, most preferably, measuring about 5 degrees. The degree of tilt may be fixed or adjustable, as desired. For example, older or more highly skilled riders may prefer a steeper incline angle $\alpha$ in order to increase the speed and thrill-level of the slide feature 100. Younger or less-skilled riders may prefer a more slight incline angle $\alpha$ in order to slow down the ride and provide increased ride safety and predictability. Suitable adjustability may be provided via an appropriate hinge mechanism in combination with one or more hydraulic jacks or the like (not shown). Alternatively, any other variety of lifting and/or height-adjustment devices well-know to those skilled in the art may be used with equal efficacy.

The entry end 120 of the slide feature 100 can be formed in virtually any diameter desired, but is typically about 20-100 ft in diameter, more preferably 40-80 ft. in diameter and, most preferably, about 60 ft. in diameter. The entry end 120 preferably includes an entry slide portion 150 sized and configured to enable one or more riders to slide down and safely enter the reducing-radius slide feature 100 with a more-or-less predicable velocity, including axial and tangential components thereof. Preferably the entry slide portion 150 includes an integrated transition portion 160 sized and adapted to safely and smoothly transition riders from a conventional slide element, such as an enclosed tube or trough, into the reducing radius slide feature 100. The transition portion 160 preferably includes optional safety containment wall 165 for ensuring the safe containment of riders and ride vehicles on the ride surface 110 as they transition from the entry slide portion 150. Indeed in one embodiment (shown in FIGS. 8 and 9), the optional safety containment wall 165 may be replaced by a funnel cap 102 as discussed further below. Of course a wide variety of other integrated and/or non-integrated entry slides may also be used, as desired. Thus, for example, while the illustrated embodiment shows a simple entry slide 150 designed for slide entry from a static starting pool or the like, those skilled in the art will readily appreciate that virtually any entry slide 150 capable of safely conveying riders and/or ride vehicles into the slide feature 100 may alternatively be used, including one or more slides extending or continuing from other slides or slide features, as discussed further below in connection with FIGS. 7 and 9.

As with the entry end 120, the exit end 130 may be formed in virtually any diameter desired, provided it is sufficiently large to safely accommodate passage of one or more riders and/or ride vehicles. Typically, exit end 130 is between about 4-20 ft in diameter and is most preferably about 12 ft. in diameter for safely accommodating one or more riders riding on a single and/or multi-passenger ride vehicle (discussed in more detail later). The ratio of entry to exit diameter of sliding surface 110 is preferably between about 3:1 to 8:1, more preferably between about 4:1 and 6:1 and most preferably about 5:1. The exit end 130 preferably includes an exit slide portion 170 sized and configured to enable one or more riders to slide down and safely exit the reducing-radius slide feature 100 with a more-or-less predicable direction and velocity. Preferably, the exit slide 170 includes an integrated transition portion 180 sized and adapted to safely and smoothly transition riders from the reducing-radius slide feature 100 to an exit splash pool (not shown) or the like. The exit slide 170 and/or transition portion 180 may include a slight turn or twist as necessary or desirable to safely guide riders from the reducing radius slide feature to a splash pool or further slide portion. Of course a wide variety of other integrated and/or non-integrated exit slides may also be used, as desired. Thus, for example, while the illustrated embodiment shows a simple exit slide 170 designed for slide exit to a splash pool or the like, those skilled in the art will readily appreciate that virtually any exit slide 170 capable of safely conveying riders and/or ride vehicles from the slide feature 100 may alternatively be used, including one or more slides extending or continuing to other slides or other slide features, again as discussed further below in connection with FIGS. 7 and 9.

As best illustrated in FIG. 2, water recirculation is preferably provided from a splash pool or other suitable water reservoir (not shown) to a start pool 155 provided at the initial entry portion of entry slide 150. A first centrifugal pump P1 or other suitable pumping means may be provided for this purpose. An optional overflow line 157 may also be provided, as desired, to allow excess water to drain back into the splash pool or other water reservoir. If desired a pair of suitably formed drains or water transfer boxes 168 (see, e.g., FIGS. 5-6) are provided at the base of the entry portion 120 of the sliding surface 110 for collecting a desired portion of run-off water from entry slide 150. Preferably, some or all of this water (and/or additional water) is provided to one or more optional water spigots 159 located at or adjacent the exit end 130 of sliding surface 110. Desirably, water spigots 159 provide increased flow of water at or adjacent the exit 130 of the slide feature 100 for slowing down riders and helping them safely exit the slide feature 100. A second centrifugal pump P2 or other suitable pumping means may be provided for this purpose. Optionally, the amount or rate of water pumped from water transfer boxes 168 by pump P2 and/or the amount or rate of water flow provided by spigots 159 may be field-adjustable such that a desired amount of water run-off may be removed from the sliding surface 110 and/or provided to spigots 159 according to various desired operating conditions. While it is not necessary to remove any water run-off from the sliding surface 110, it may be desirable in some cases, as too much water run-off can flood the lower base portion of the sliding surface, causing riders to quickly lose speed and momentum and thereby diminishing some of the desired effects and thrill value of the slide feature 100. Adjustability of pump P2 may be provided using an electric motor with appropriately selected motor speed control, such as a pulse-width modulated or phase-controlled power source.

Preferably, the sliding surface 110 is lubricated with a thin film of water or other lubricating substance (liquid or solid) in order to reduce friction during ride operation. Most preferably, a water sprinkler system is provided comprising one or more water-injection rails 161 mounted on or adjacent to sliding surface 110 and having multiple water sprinkler or injection nozzles 163, as illustrated, for spraying a desired amount of water sufficient to keep sliding surface 110 wet. If convenient, water may be supplied to the water sprinkler system by pumps P1 and/or P2 or, alternatively, by a third centrifugal pump P3 or other suitable pumping means, as illustrated. If desired, the rate of water pumped to the water sprinkler system may be field-adjustable such that a desired amount of surface wetting and lubriciousness may be attained for the sliding surface 110 according to various desired operating conditions. While it is not necessary to provide a water sprinkler system, it may be desirable in many cases (particularly in dry areas), as the sliding surface can occasionally become dry, causing riders to quickly lose speed and momentum, thereby diminishing some of the desired effects and thrill value of the slide feature 100. Adjustability of pump P3 may be provided using an electric motor with appropriately selected motor speed control, such as a pulse-width modulated or phase-controlled power source.

Figure 3:
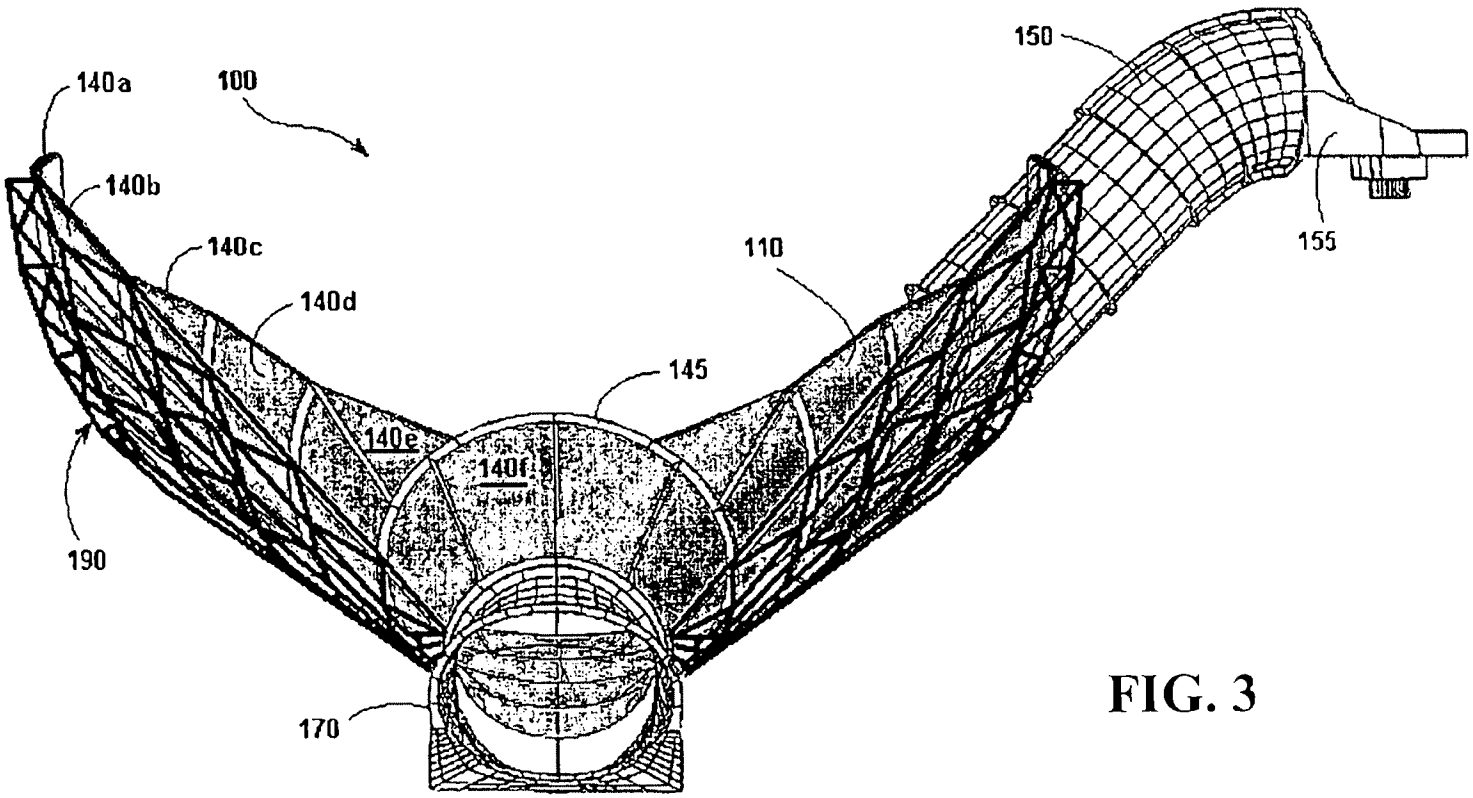
FIG. 3 is a partial cut away rear side elevation view of the reducing radius slide feature of FIG. 1.

FIG. 3 is a partial cut away rear side elevation view of the slide feature 100 shown and described above, illustrating in more detail a preferred construction thereof. The sliding surface 110 may be fabricated and assembled using any one or more suitable materials and construction techniques as are well known to persons skilled in the art. Preferably, a molded reinforced fiberglass material is used for the sliding surface 110 and entry and exit slides 150, 170. If desired, the entire slide surface 110 may be suitably designed, engineered and constructed using one or more smaller, prefabricated sections 140*a-f* sized and shaped so as to be easily transported and assembled on site using, for example, lock-tight bolts, rivets and/or adhesives to form the desired slide feature 100. Internally exposed seams 145 and unfinished surfaces may be filled and sanded smooth using a fiberglass resin and/or similar filling material, such as Bondo™ fiberglass filler. While fiberglass is a particularly preferred material for sliding surface 110 and entry/exit slides 150, 170, any variety of other suitable materials may also be used, such as plastics, thermosets, concrete, gunite and other similar materials well know to those skilled in the art. If desired, the entire slide surface or any portion thereof may be also coated with an optional layer of foam or other soft material to provide a smooth, lubricious, impact-safe sliding surface. Other surface coatings designed to increase lubriciousness and/or durability are also available and may be used, as necessary or desirable.

An optional supporting framework, such as a steel superstructure 190, may be provided for added rigidity and structural integrity. This superstructure may be fabricated, for example, from zinc-plated, galvanized and/or anodized steel angle iron using conventional truss and space-frame construction and pinned to each segment 145*a-f* of the fiberglass sliding surface 110, for example, at the seams 145 thereof. Alternatively, various supplemental support structures or other supporting elements may be integrated into each of the prefabricated segments 145*a-f* and sized and configured such that little or no external support structure is necessary to support the slide feature 100. Alternatively and/or in addition, the riding surface 110 may be fully or partially structurally reinforced by steel cables or bands wrapped around the outer periphery of the riding surface 110 at various diameters and tensioned so as to provide a desired amount of strength and rigidity.

Figure 4:
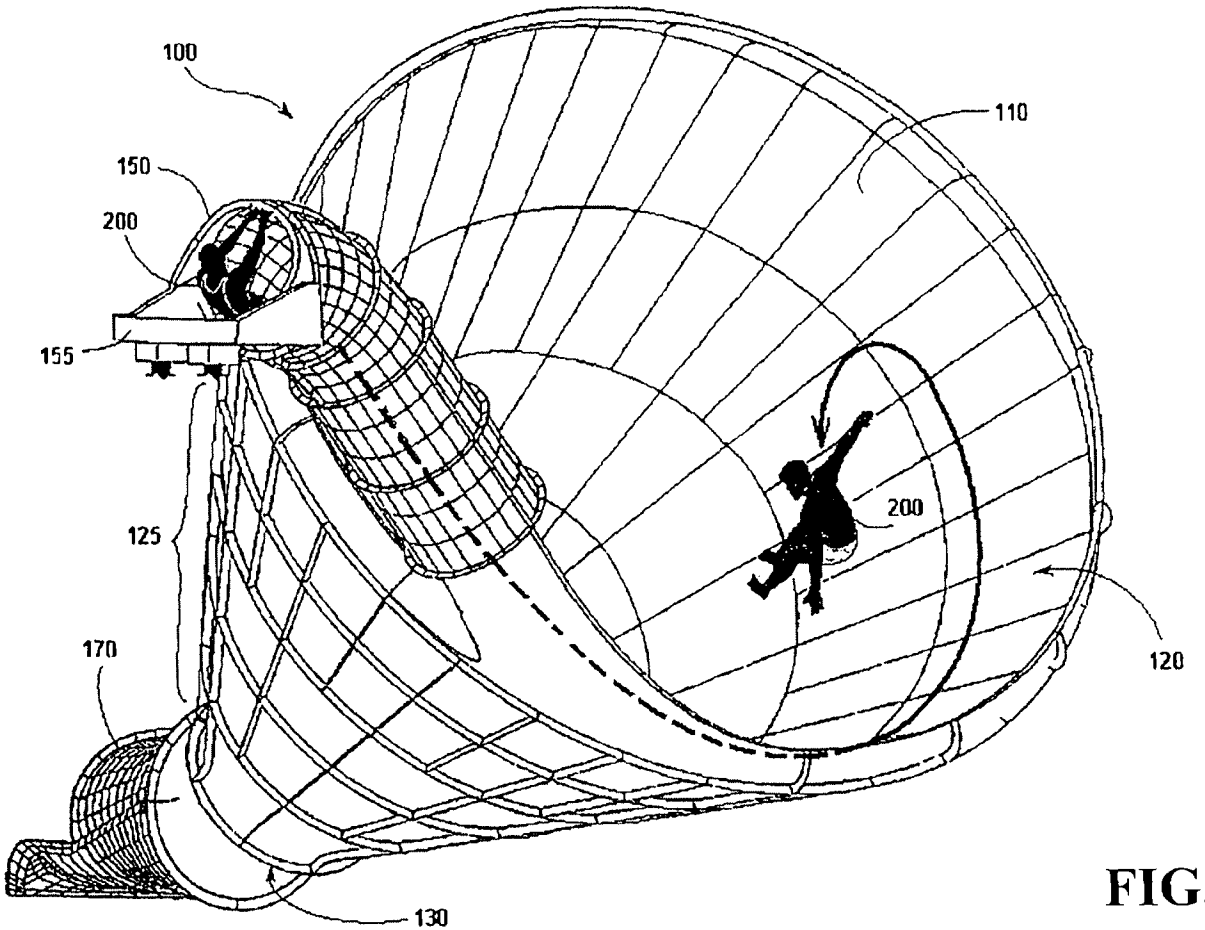
FIG. 4 is a front perspective view of the reducing radius slide feature of FIG. 1.

As noted above, the main body portion 125 of the slide surface 110 preferably smoothly tapers and transitions from entry end 120 to exit end 130. The rate of taper of slide surface 110 from entry to exit end may be constant or varying, as desired. The optimal design taper rate will depend, among other things, on the overall size of the funnel 110, the design entry speed of the rider 200 (see FIG. 4), and the incline angle $\alpha$ of sliding surface 110 relative to horizontal (see FIG. 1). Preferably, the taper rate is sufficiently large, given the probable speed and direction of rider 200, so as to maintain the velocity and high-wall riding excitement of the rider 200 as he or she slides back and forth through the slide feature 100, but not so large as to present a danger of injury to the rider 200. Typically, a constant taper rate of between about 0.5 and 3.0 (unit reduction in diameter per unit axial length) is provided from the entry to the exit. Most preferably, a constant taper rate of about 1.0 is provided from entry to exit. Alternatively, those skilled in the art will readily appreciate that a wide variety of alternative taper rates and taper designs may be used for added interest, uniqueness or thrill value. For example, an accelerating or decelerating taper rate may be used to provide a flared or horn-shaped funnel, if desired.

In use (see FIG. 2), a rider 200 ascends (via an access ramp or stairs, not show) to the start pool 155 at the beginning of entry slide 150. Rider 200 enters the slide 150 in a conventional fashion by self-releasing into the tube 150 or, more preferably, floating in a timed flood of water released from start pool 155. The size, height and orientation of entry slide 150 is preferably selected such as to safely deliver ride participant 200 onto the slide surface 110 with at least one velocity component generally tangential to the slide surface 110 (generally perpendicular to and offset from the central axis of the reducing radius slide feature 100). The rider 200 is initially carried by momentum up an opposing side wall of sliding surface 110, possibly even ascending past a vertical slope (greater than 90 degrees). Gradually the rider 200 exchanges kinetic energy for gravitational energy until virtually all kinetic energy is depleted. At this point the rider changes direction and begins to descend the wall, sliding with increasing velocity toward the opposing wall of sliding surface 110, again possibly ascending past a vertical 90 degree slope. The rider 200 repeatedly exchanges kinetic and gravitational energy as he or she oscillates back and forth within the funnel 100, eventually being guided to exit portion 130. Under certain advanced operating conditions, experienced riders may also be able to complete one or more spirals around the slide surface 110 (completing multiple 360 degree loops or turns) as they descend into the reducing radius slide feature 100 toward the exit 130. This advanced operating mode may be achieved, for example, by increasing the incline angle $\alpha$ of the funnel and/or by increasing the entry velocity of riders 200 via injected water flow acceleration, higher entry slides and the like. Once the ride is completed exit slide 170 guides riders 200 into a splash pool or other splash-down area or, alternatively, it connects riders to a further slide or tube ride of any desired length and design.

Figure 5:
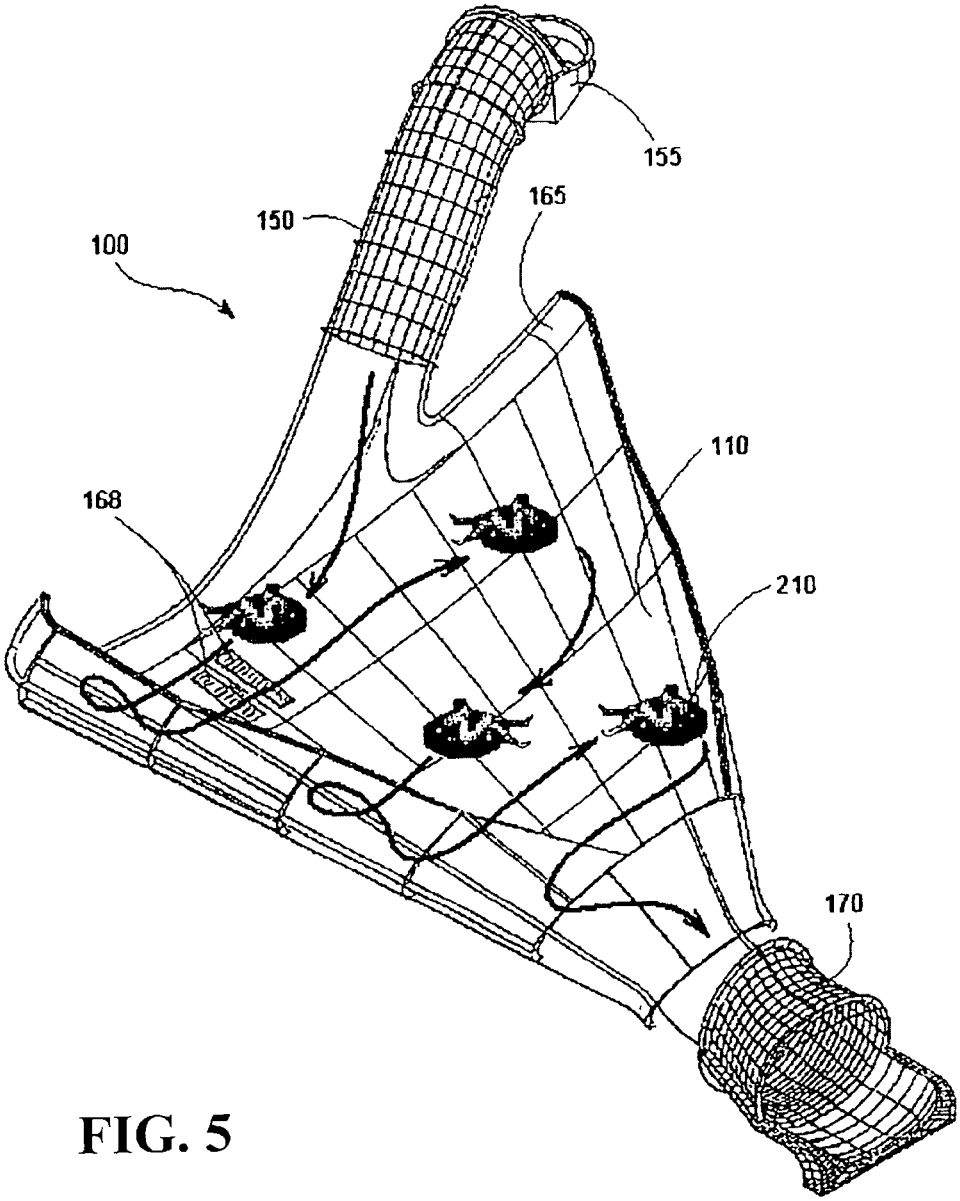
FIG. 5 is a partial cut away rear perspective view of an alternative embodiment of a reducing radius slide feature having features and advantages of the present invention adapted for use with an innertube ride vehicle.

FIG. 5 is a partial cut away rear perspective view of an alternative embodiment of a reducing radius slide feature 100 having features and advantages of the present invention particularly adapted for use with an innertube or raft-like ride vehicle 210. In this case a rider 200 with innertube ride vehicle 210 (or a similar ride vehicle) ascends to the start pool 155 at the beginning of entry slide 150. Rider 200 and inner-tube 210 are released into entry tube via a timed flood of water released from start pool 155. The size, height and orientation of entry slide 150 is preferably selected such as to safely deliver rider/vehicle 210 onto the slide surface 110 with at least one velocity component generally tangential to the slide surface 110. The rider/vehicle 210 is initially carried by momentum up an opposing side wall of sliding surface 110. Gradually the rider/vehicle 210 exchanges kinetic energy for gravitational energy until virtually all kinetic energy is depleted. At this point the rider/vehicle 210 changes direction and begins to descend the wall, sliding with increasing velocity toward the opposing wall of sliding surface 110. The rider/vehicle 210 repeatedly exchanges kinetic and gravitational energy as he or she oscillates back and forth within the funnel 100, eventually being guided to exit portion 130 and exit slide 170. Once the ride is completed exit slide 170 guides rider/vehicle 210 into a splash pool or other splash-down area or, alternatively, connects riders to a further slide or tube ride of any desired length and design.

Advantageously, as the rider/vehicle 210 loses absolute energy to frictional losses the tapered shape of the reducing radius slide feature effectively focuses and amplifies the remaining energy of the rider by continually reducing the radius of the sliding surface as the rider traverses axially along the reducing radius slide feature 100. Thus, rider velocity and excitement is maintained throughout virtually the entire ride as the rider continues to experience the thrill and high-wall riding excitement of the reducing radius slide feature 100. The tapered shape of the ride surface also shortens and speeds the effective rider path through the slide feature 100, thereby increasing rider throughput without diminishing rider enjoyment.

Figure 6:
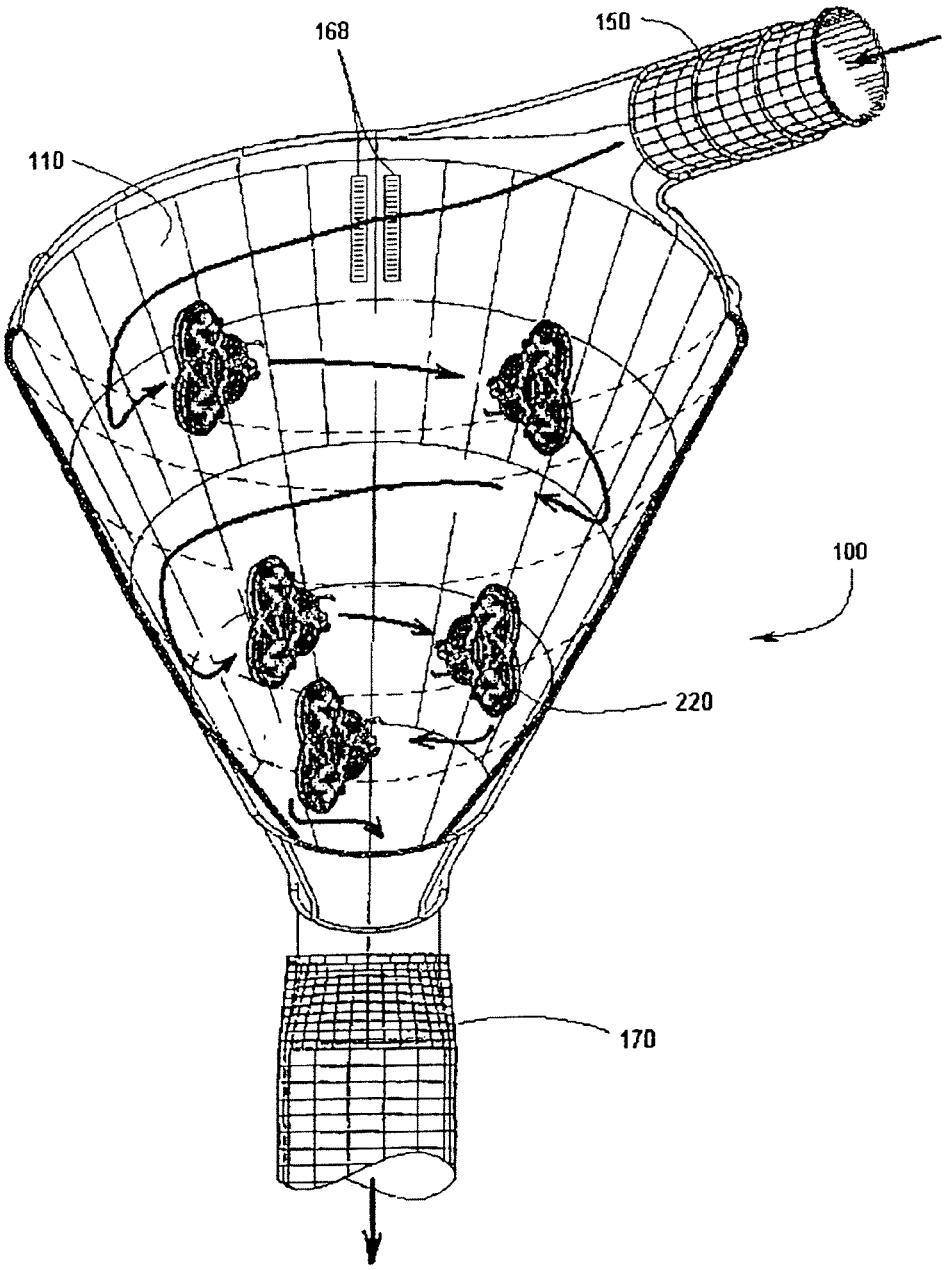
FIG. 6 is a partial cut away rear perspective view of an alternative embodiment of a reducing radius slide feature having features and advantages of the present invention integrated as part of a larger slide experience and adapted for use with a multi-passenger ride vehicle.

FIG. 6 is a partial cut away back perspective view of an alternative embodiment of a reducing radius slide feature having features and advantages of the present invention integrated as part of a larger slide experience and adapted for use with a multi-passenger ride vehicle, such as multi-person innertubes, wet/dry ride vehicles, and/or various wheel-suspended vehicles and the like. In this case multi-passenger wet/dry ride vehicles 220 enter entry tube 150 from an adjacent ride segment (not shown). Preferably, the entry speed of the ride vehicle 220 is regulated (e.g., by a stop-and-release gate and/or other means), so that safety is maintained as the vehicle 220 is delivered to the sliding surface 110. The vehicle 220 is initially carried by momentum up an opposing side wall of sliding surface 110, but preferably not exceeding a vertical slope. Gradually the vehicle 220 exchanges kinetic energy for gravitational energy until virtually all kinetic energy is depleted. At this point the vehicle 220 changes direction and begins to descend the wall, sliding with increasing velocity toward the opposing wall of sliding surface 110. The vehicle 220 repeatedly exchanges kinetic and gravitational energy as it oscillates back and forth within the funnel 100, eventually being guided to exit portion 130 and exit slide 170. Once the ride is completed exit slide 170 preferably guides vehicle 220 to a continuing slide or tube ride of any desired length and design.

Figure 7:
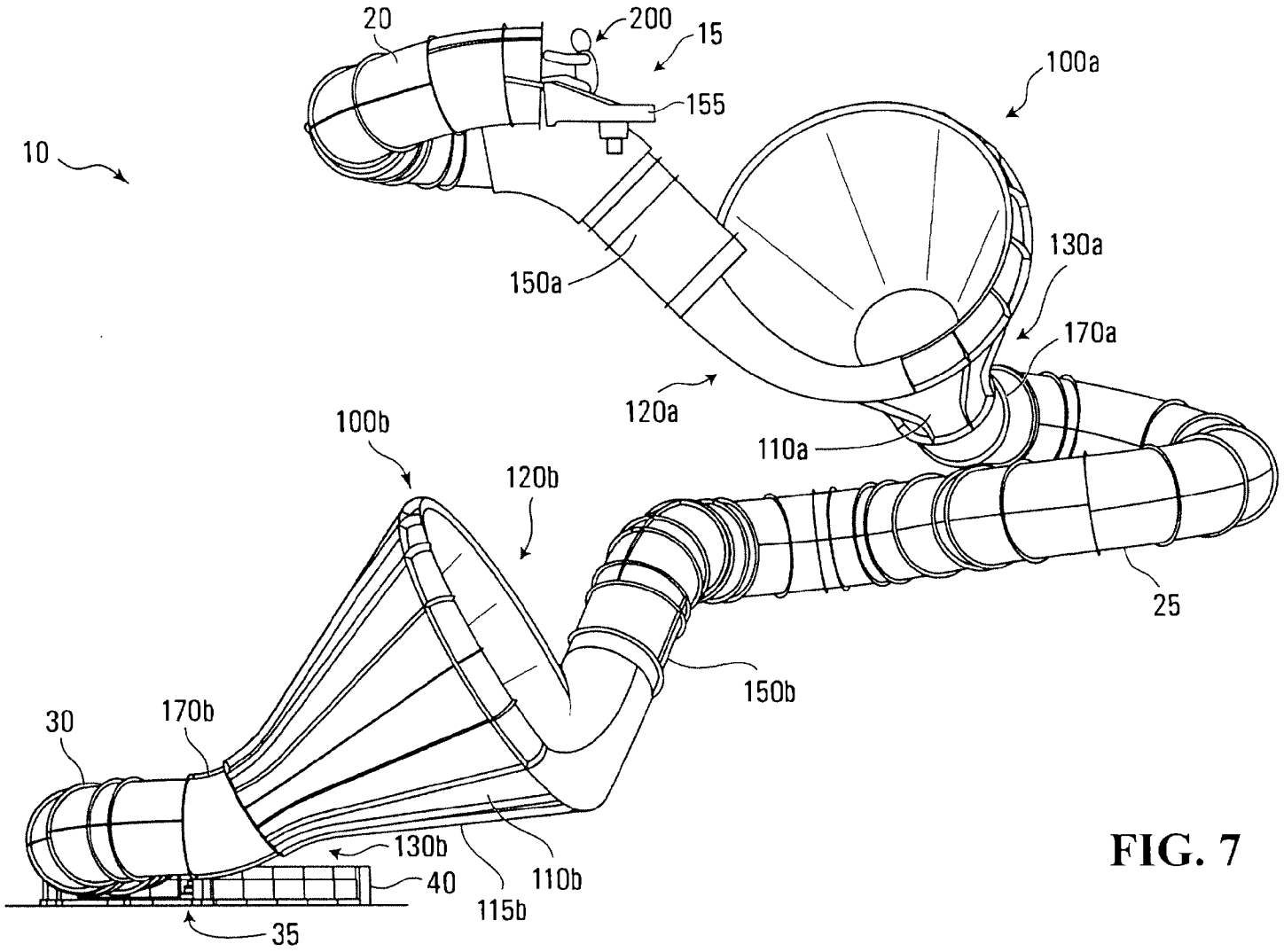
FIG. 7 is a side elevation view of a flume ride having a plurality of the slide features of FIG. 1.

FIG. 7 illustrates a flume ride 10 in accordance with another embodiment of the present invention, having a plurality of reducing radius slide features, in this case a first slide feature 100*a* and a second slide feature 100*b*. Although FIG. 7 depicts a flume ride having two slide features 100*a* and 100*b*, it is to be understood that the present invention contemplates a flume ride having only one, or more than two such slide features.

The flume ride 10 comprises an entry point 15 encompassing a start pool 155 where a rider 200 enters the flume ride. The start pool 155 connects to a first slide portion 20. The first slide portion 20 connects to a first entry slide 150*a* at a first entry end 120*a* of the first slide feature 100*a*. In further embodiments, the first slide portion 20 need not be present and the start pool 155 could be connected directly to or be integral with the first entry slide 150*a* of the first slide feature 100*a*. The first slide feature 100*a* includes a first sliding surface 110*a* and a first exit slide 170*a* at a first exit end 130*a*. Details regarding the construction of the first slide feature 100*a*, including the first entry end 120*a*, first entry slide 150*a*, first exit end 130*a* and first exit slide 170*a* have been previously discussed above.

The first exit slide 170*a* is connected to a second slide portion 25, which in turn is connected to a second entry slide 150*b* at a second entry end 120*b* of the second slide feature 100*b*. Alternatively, the first exit slide 170*a* of the first slide feature 100*a* could be connected directly to or be integral with the second entry slide 150*b* of the second slide feature 100*b*. The second slide feature 100*b* has a second sliding surface 110*b*. A second exit slide 170*b* at a second exit end 130*b* of the second slide feature 100*b* is connected to a third slide portion 30, which in turn is connected to a splash pool or other splash-down area 40 at an exit point 35. Alternatively, the second exit slide 170*b* of the second slide feature 100*b* could be connected directly to or be integral with the splash pool or other splash-down area 40.

The start pool 155, first, second and third slide portions 20, 25 and 30 and exit point 35 incorporating a splash pool or other splash down area 40 are constructed in a manner known to those skilled in the art. It will be understood that the first, second and third slide portions 20, 25 and 30 can be of any appropriate length and can incorporate any suitable sliding elements generally known in the art such as twists, bends, turns, declines, and the like. Structural support for the flume ride 10 including the first and second slide features 100*a*, 100*b*, and the system for water circulation throughout flume ride 10, is not shown. However, structural support and water circulation can be accomplished in any appropriate manner as known in the art.

In use, a rider 200 enters the flume ride 10 at the entry point 15. The rider 200 travels from the start pool 155 at the entry point 15 along the first slide portion 20 to the first entry slide 150*a* of the first slide feature 100*a*, whereupon the rider 200 enters the first slide feature 100*a*. Details regarding the operation of and the rider's experience in the first entry slide 150*a*, first slide feature 100*a* and first exit slide 170*a* are discussed above. The rider 200 exits the first slide feature 100*a* by way of the first exit slide 170*a*, and travels along the second slide portion 25 to the second entry slide 150*b* of the second slide feature 100*b*. The operation of the second entry slide 150*b*, second slide feature 100*b* and second exit slide 170*b* is similar to that described for the first slide feature 100*a*. The rider exits the second slide feature 100*b* by way of the second exit slide 170*b*, and travels along the third slide portion 30 to a splash pool or other splash-down area 40 at the exit point 35, whereupon the rider 200 exits the flume ride 10.

Figure 8:
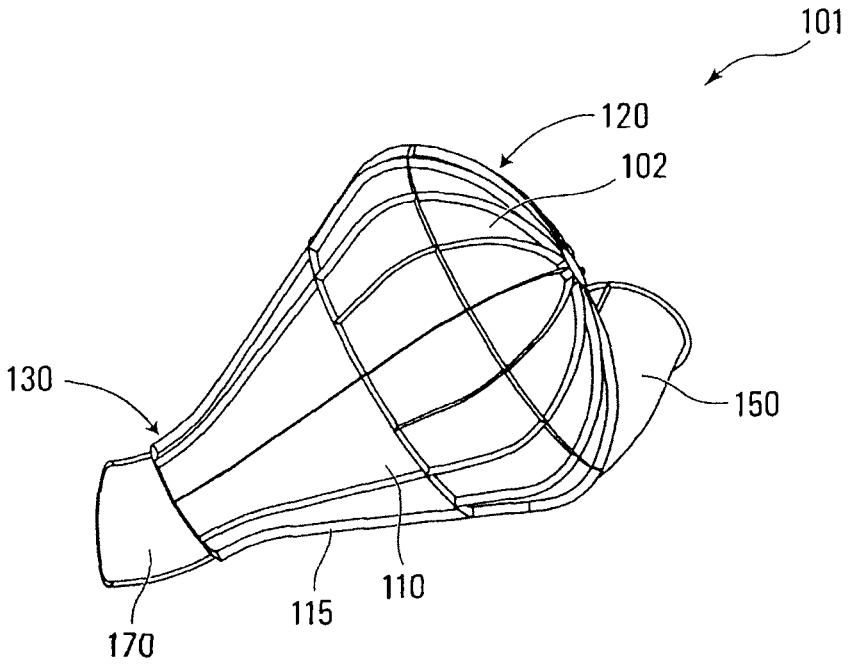
FIG. 8 is a side elevation view of an alternative embodiment of a reducing radius slide feature wherein the slide feature is fully enclosed.

While the slide feature of the preferred embodiment of the present invention has been described and illustrated as being substantially enclosed, with a substantially complete conical sliding surface 110 but having a substantially open entry end 120, FIG. 8 illustrates a further embodiment of the slide feature of the present invention in which the slide feature is fully enclosed. The fully enclosed slide feature 101 of FIG. 8 is fully enclosed insofar as it comprises a substantially complete conical sliding surface 110 as well as a funnel cap 102 substantially covering the entry end 120. Entry and exit slides 150 and 170 communicating with the interior of the fully enclosed slide feature 101 allow rider entry and exit into the fully enclosed slide feature 101 in the same manner described above with respect to the substantially enclosed slide feature of FIG. 1.

The funnel cap 102 of FIG. 8 is rounded and is attached to, or is integral with, the conical sliding surface 110 of the fully enclosed slide feature 101. In the embodiment illustrated in FIG. 8, the funnel cap 102 completely covers the entry end 120 of the slide feature 101 so as to act as a safety barrier that eliminates the possibility of a rider 200 accidentally exiting the slide feature 101 at the entry end 120. The funnel cap 102 further restricts the entry of external light into the fully enclosed slide feature 101, thus providing a thrilling ride experience in a slide feature that is substantially or completely dark.

The amount of light which is allowed to enter the fully enclosed slide feature 101 (and thus the environment within the slide feature) can be controlled by the presence of clear sections or openings (not shown), some or all of which could be adjustable, in any appropriate location in the funnel cap 102, sliding surface 110, or elsewhere, through which selected amounts of light may be allowed to pass. It will be understood that one or more openings (not shown), some or all of which may be adjustable, may be required at appropriate locations in the fully enclosed slide feature 101 to control the temperature and ventilation within the slide feature 101.

In addition, the fully enclosed slide feature 101 could incorporate a waterproof lighting system (not shown) that might comprise flashing and/or coloured lights, or any other lighting method or technique known in the art. Use by a rider of the slide feature 101 as discussed above in a substantially or completely dark environment while being exposed to light emitted from the lighting system, would again result in a more thrilling sliding experience for the rider.

It will be understood by those skilled in the art that the fully enclosed reducing radius slide feature 101 can be adapted not only for use by a rider 200, but also for use by an innertube or raft like vehicle 210, or multi-passenger wet/dry ride vehicles 220, such as multi-person innertubes, wet/dry ride vehicles, and/or various wheel-suspended vehicles and the like.

Figure 9:
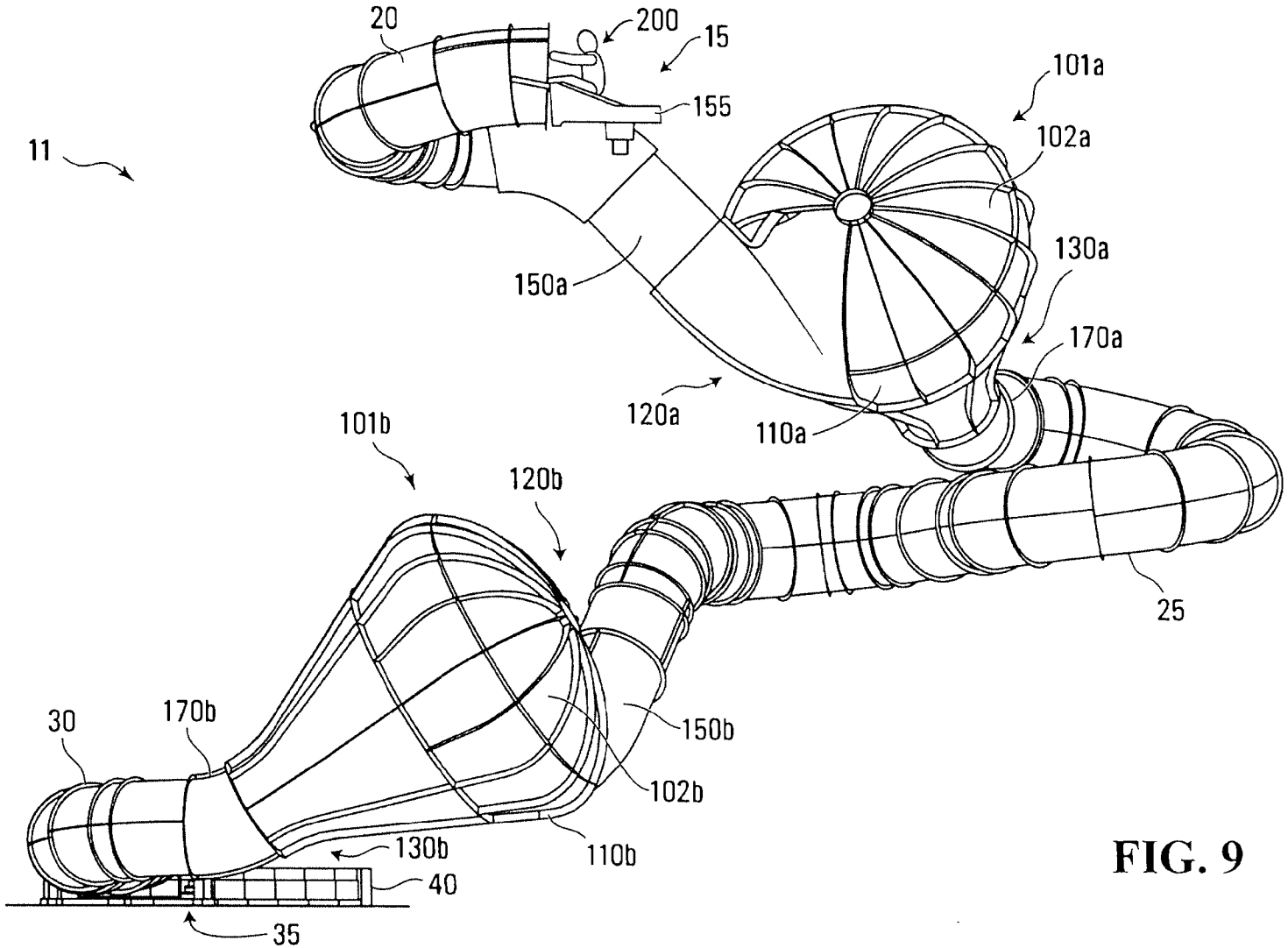
FIG. 9 is a side elevation view of a flume ride having a plurality of the slide features of FIG. 8.

FIG. 9 illustrates a flume ride 11 having multiple fully enclosed slide features 101*a*, 101*b*. The flume ride of FIG. 9 is substantially the same in construction and operation as the flume ride of FIG. 7 discussed above, except that the slide features 101*a*, 101*b* are fully enclosed, having first and second funnel caps 102*a*, 102*b*.

With reference to FIGS. 7 and 9, it will be understood that the slide features of the flume rides 10, 11 need not all be identical in construction, but could be any appropriate combination of different slide features. For example, one or more of the slide features may be substantially enclosed, while one or more of the other slide features may be fully enclosed. In addition, the sliding surface of the slide features, whether substantially or fully enclosed, could be any combination of suitable symmetric or non-symmetric reducing radius shapes, including funnel, oblong, horn, flared horn or bell-shaped funnel and the like.

The various preferred embodiments illustrated and described above are configured for optimal use as a wet water ride using one or more single and/or multi-passenger ride vehicles. However, those skilled in the art will readily appreciate that a flume ride and/or other similar ride could alternatively be configured and used with or without a ride vehicle and as either a dry slide and/or a water slide. Moreover, while gravity induced rider/vehicle movement along the various sliding surfaces is preferred, those skilled in the art will readily appreciate that any or all portions of the various sliding surface and/or riding vehicles may be power assisted, for example, via water injection devices, conveyer belts, chain drive mechanisms, rider-operated devices, braking devices, and/or the like. Moreover, the ride vehicle 220 and/or riders thereon may be equipped, if desired, with one or more rider-operated devices for selectively admitting and/or expelling water into the vehicle in order to increase or decrease its mass and/or friction coefficient for purposes of altering its kinetic energy before or after entering the slide feature 100. This may comprise, for example, a simple pump and/or one or more on-board or out-board water-pockets for receiving and temporarily storing a desired quantity of water.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

The invention claimed is:

1. A slide feature adapted to carry one or more riders and/or ride vehicles sliding thereon comprising:

a sliding surface having a first end and a second end; the sliding surface comprising at least a lower portion of a sideways tilted funnel shape, wherein a radius of the sliding surface tapers from the first end to the second end; a lowermost surface of the sliding surface is horizontal or slightly inclined from horizontal descending from the first end to the second end; the sliding surface comprising side walls each extending upward from the lowermost surface about a longitudinal axis which would be defined by the complete sideways tilted funnel shape through an angle of more than 90°; and wherein the first end is substantially larger in diameter than the second end.

2. The slide feature of claim 1, wherein the first end is at least a lower portion of a substantially circular shape, having a diameter of between about 20 and 100 feet.

3. The slide feature of claim 1, wherein the ratio of the diameters of the first end and the second end is between about 8:1 and 3:1.

4. The slide feature of claim 1, wherein the lowermost surface of the sliding surface is inclined from horizontal descending from the first end to the second end at an angle of between about 0 and 30 degrees from horizontal.

5. The slide feature of claim 1, wherein the sliding surface is tilted such that a rider/vehicle entering the sliding surface is caused to swing back and forth upon the sliding surface as he or she advances through the slide feature.

6. A slide feature adapted to carry one or more riders and/or ride vehicles sliding thereon comprising:

a curved sliding surface having an entry end and an exit end, each location on the sliding surface being curved about an axis of curvature; a lowermost surface of the sliding surface parallel to or slightly inclined from horizontal descending from the entry end to the exit end; the sliding surface comprising side walls each extending upward from the lowermost surface about the axis of curvature through an angle of more than 90° at each location on the sliding surface.

7. The slide feature of claim 6, wherein the entry end of the sliding surface further comprises a transition entry slide portion for receiving riders/vehicles from a main slide path and directing the riders/vehicles onto the sliding surface with sufficient tangential and axial velocity components for at least some of the riders/vehicles to travel up at least one side wall of the side walls at least partially above an angle of 90 degrees measured from the lowermost surface about the axis of curvature at that location of the side wall.

8. The slide feature of claim 6, wherein the sliding surface is tilted such that a rider/vehicle entering the sliding surface at the entry end is caused to swing back and forth upon the sliding surface as he or she advances through the slide feature toward the exit end.

9. A slide feature comprising:

an entry slide path sized and adapted to carry one or more riders and/or ride vehicles sliding thereon; and a main portion generally symmetrically formed about a central axis, the main portion having an enclosed sliding surface, an entry end sized and adapted for receiving riders/vehicles from the entry slide path, and an exit end, wherein the main portion is tilted on its side relative to a central axis thereof such that a lower-most surface thereof is at least parallel to or slightly inclined from horizontal descending from the entry end to the exit end, the entry end is substantially larger in diameter than the exit end, and the entry end of the main portion is substantially covered.

10. The slide feature of claim 9, wherein the ratio of the diameters of the entry end and the exit end is between about 8:1 and 3:1.

11. The slide feature of claim 9, wherein the ratio of the diameters of the entry end and the exit end is between about 6:1 and 4:1.

12. The slide feature of claim 9, wherein the ratio of the diameter of the entry end and the entry end is about 5:1.

13. The slide feature of claim 9, wherein the sliding surface is tilted on its side such that the lower-most surface thereof is inclined at an angle of between about 0 and 30 degrees from horizontal.

14. The slide feature of claim 9, wherein a rider/vehicle entering the main portion is caused to swing back and forth upon the sliding surface as he or she advances through the sliding surface toward the exit end.

15. The slide feature of claim 9, wherein the sliding surface substantially smoothly tapers at the exit end in accordance with a predetermined taper function.

16. The slide feature of claim 9, wherein the entry end is substantially round.

* * * * *